United States Patent [19]

Brunette

[11] 4,121,856

[45] Oct. 24, 1978

[54] IDENTIFICATION ASSEMBLY AND METHOD

[76] Inventor: Jerome J. Brunette, 911 Cambridge Dr., Libertyville, Ill. 60048

[21] Appl. No.: 808,829

[22] Filed: Jun. 22, 1977

[51] Int. Cl.[2] ..... G09F 3/10; B41L 1/00

[52] U.S. Cl. ..... 282/1 R; 283/21

[58] Field of Search ..... 282/19 R, 28 R, 1 R; 283/18, 21 R

[56] References Cited

U.S. PATENT DOCUMENTS

| | | | |
|---|---|---|---|
| 2,648,924 | 8/1953 | Brewster | 282/1 R |
| 3,383,121 | 4/1968 | Singer | 283/21 |
| 4,004,058 | 1/1977 | Buros et al. | 283/21 |

*Primary Examiner*—Donald R. Schran

*Attorney, Agent, or Firm*—Tilton, Fallon, Lungmus & Chestnut

[57] ABSTRACT

An identification assembly and method employing a self contained carbonless image sheet having a transparent film integral with one face thereof.

2 Claims, 6 Drawing Figures

IDENTIFICATION ASSEMBLY AND METHOD

BACKGROUND AND SUMMARY OF INVENTION

This invention relates to an identification assembly and method of use and, more particularly, to a method wherein an identification assembly such as a label can be created rapidly and thereafter serve its function in relatively secure fashion. To this end, two sheets are initially provided which are disposed in face-to-face relationship with the upper of the sheets being a generally transparent film. This upper sheet is bonded to the lower sheet constructed of self-contained carbonless image forming paper. When pressure, as from a typewriter is applied to the assembled sheets, an image is created on or in the lower sheet. Once the assembly is equipped with information, there is provided an indicia which is relatively permanent, carries with it its own protective layer and is relatively impervious to alteration of the initial information.

Other objects and advantages of the invention may be seen in the details of construction and operation as set forth in the ensuing specification.

DETAILED DESCRIPTION

The invention is described in conjunction with the accompanying drawing, in which FIG. 1 is a fragmentary perspective view of an identification assembly constructed according to the invention;

Figure 1:
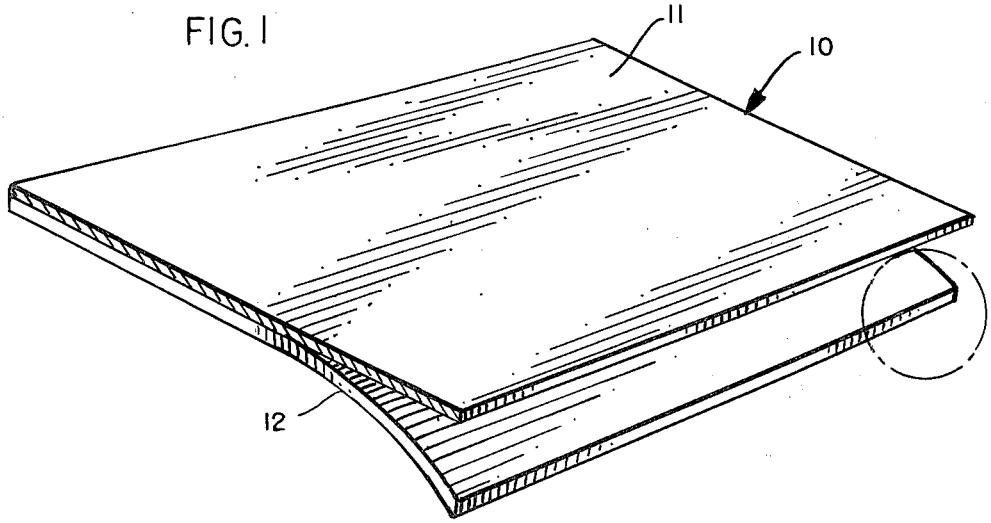
Figure 2:
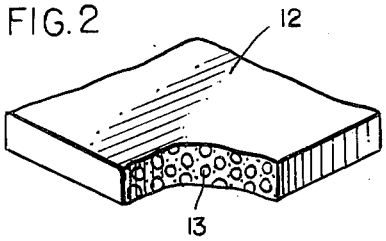
FIG. 2 is an enlarged sectional view of the encircled portion of FIG. 1.
Figure 3:
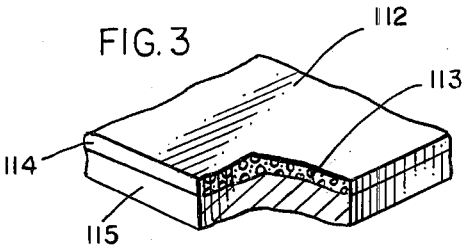
FIG. 3 is a view similar to FIG. 2 but of a different substrate.

In the illustration given, and with reference to FIG. 1, the numeral 10 designates generally an identification assembly made according to the instant invention. The assembly 10 includes as an upper sheet a transparent film which is bonded to a self-contained carbonless image sheet 12. As a specific example of the invention, the transparent filem can be an ethylene-terrephthalate such as "Mylar" marketed by E. I. duPont. Other thin films, of the order of 0.0005–0.005 inch such as polyvinyl acetate, polyvinyl chloride, polyethlyene, and polyproplyene (these being commercially available at reasonable prices) may be employed. For the sheet 11 a carbonless paper such as the "ACTION" paper (type 100) of 3M Company may be advantageously employed. Other similar papers are also available which create an image on or in the paper depending upon the character of the encapsulation. For example, the form of sheet 12 illustrated in FIG. 2 has the image forming elements 13 entirely self-contained, being blended in with the pulp paper fibers during manufacture. In contrast, the sheet 112 of FIG. 3 has the imaging elements 113 dispersed in a surface coating 114 on a substrate 115. Such a sheet 112 is especially advantageous for machines applying a light stroke for creating the image.

The film 11 and sheet 12 are integrated or bonded by a variety of means such as a pressure sensitive or other adhesive. A wide variety of such adhesives can be employed depending upon the character of the film 11 and sheet 12 or 112. When using the sheet 112, the image created is apparent from only one side so as to avoid any possibility of misapplying the identification assembly. In the instance of employing the sheet 12, an opaque film or liner can be employed so as not to mount the identification assembly in a fashion so that the image or message appears backward.

Through the practice of the invention, an identification assembly is provided which has a strong degree of permanance particularly inasmuch as the message containing portion is protected by the integrated film 11. Also characteristic of the invention is a degree of unalterability. Information is extremely difficult to delete but there is the possibility of adding information but in view of the coaction of the film 11 and sheet 12, the added information usually would be presented in somewhat different character or line so as to permit detection of the same.

The invention can be used to advantage in a variety of environments such as shipping labels, packing list envelopes, shipping paper containers, bottle labels, prescription labels, identification means such as hospital armbands, membership cards, licenses and renewals, product identifications, plastic bag header cards, price marking, batch identification, film marking, signature authorization and the like.

Figure 5:
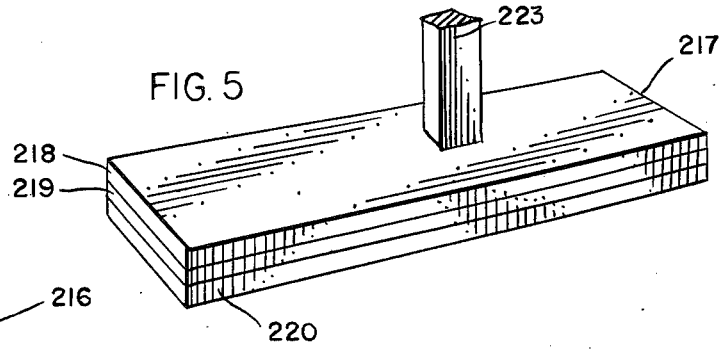
FIG. 5 is a perspective view depicting schematically the creation of an image on one of the identification assemblies of FIG. 4.
Figure 4:
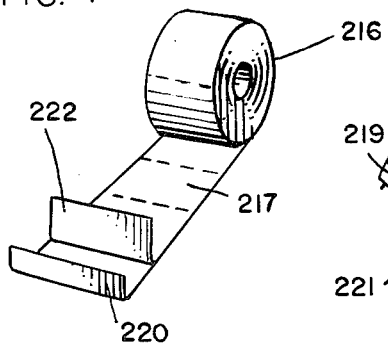
FIG. 4 is a perspective view of a roll of identification assemblies incorporating teachings of this invention.

In the embodiment of the invention illustrated in FIG. 4, the numeral 216 designates generally a roll or label assemblies incorporating teachings of the instant invention. Each individual label assembly 217 is made up essentially of three sheets arranged in face-to-face contacting relation as can be appreciated from a consideration of FIG. 5. In FIG. 5, the upper sheet (depicted schematically) is designated 218 and includes a transparent film such as that previously described with reference to the film 11.

Figure 6:
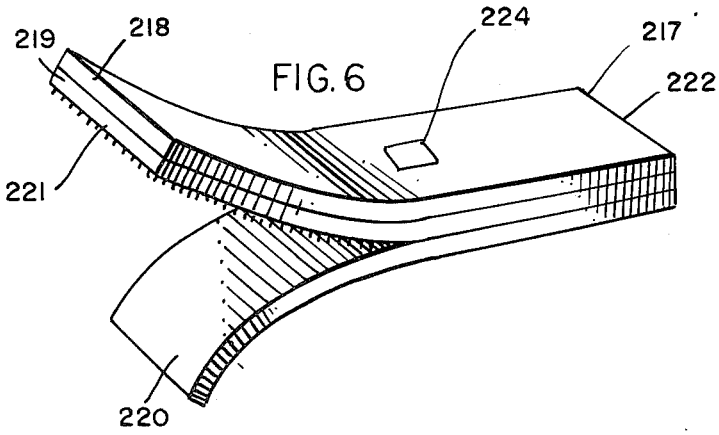
FIG. 6 is another perspective view showing portions of the identification assembly in the process of being separated.

The intermediate layer or sheet 219 is the self-contained image sheet corresponding to the sheets 12 or 112 previously described. The bottom sheet 220 is a release film — usually silicone coated. The underside of the sheet 219 is advantageously coated with a pressure sensitive adhesive 221 (see FIG. 6). In FIG. 6, the label 217 is seen in the process of disassembly, i.e., separating the identification assembly 222 consisting of the film 218 and sheet 219 from the release sheet or liner 220. The liner 220 is then discarded and the resultant unit portion 222 of the label assembly is applicable to a label receiving surface.

In FIG. 4, the roll 216 is seen partially unwound and the release liner 220 partially disassembled from the identification assembly 222. It will be appreciated that the liner can be wound on either the inside or outside of the label assembly depending upon the location of one adhesive.

Illustrating schematically the use of the invention, an image forming marking element is designated by the numeral 223 in FIG. 5 which results in an image 224 as seen in FIG. 6.

It will be appreciated that the end usage of the identification assembly may dictate the most advantageous way of securing or mounting the same. For example, although the assembly has been illustrated with the various sheets being coextensive, certain of the sheets, particularly the film 11, may be larger so as to provide a perimetric portion equipped with adhesive for applying the ultimate identification assembly to a label.

I claim:

1. A label assembly comprising a self contained carbonless sheet having a multitude of minute, liquid containing capsules and adapted to provide an image when pressure is applied thereto to rupture selected ones of said capsules, said sheet having first and second sides, an adhesive on said first side, and a transparent film overlying and attached to said second side said film being a member selected from the class consisting of ethylene-terrephthalate, polyvinyl acetate, polyvinyl chloride, polyethylene and polypropylene and having a thickness of the order of about 0.0005 inch to about 0.005 inch whereby indicia may be inscribed on said carbonless sheet through said film and said carbonless sheet applied to an object to be labeled to provide a relatively tamperproof label.

2. The assembly of claim 1 in which said adhesive is pressure sensitive, and a release sheet covering said adhesive is temporarily attached to said first side.

* * * * *